US006305311B1

(12) United States Patent
Cooke

(10) Patent No.: US 6,305,311 B1
(45) Date of Patent: Oct. 23, 2001

(54) KAYAK BACK-BAND INSTALLATION ASSEMBLY AND METHOD FOR INSTALLING A BACK-BAND IN A KAYAK

(75) Inventor: John Spencer Cooke, Boone, NC (US)

(73) Assignee: Immersion Research, Inc., Confluence, PA (US)

( * ) Notice: Subject to any disclaimer, the term of this patent is extended or adjusted under 35 U.S.C. 154(b) by 0 days.

(21) Appl. No.: 09/734,447

(22) Filed: Dec. 11, 2000

(51) Int. Cl.[7] ..... B63B 35/00

(52) U.S. Cl. ..... 114/347; 114/363

(58) Field of Search ..... 114/343, 347, 114/363

(56) References Cited

U.S. PATENT DOCUMENTS 5,970,903 * 10/1999 McDonough et al. ..... 114/347

* cited by examiner

*Primary Examiner*—Ed Swinehart
(74) *Attorney, Agent, or Firm*—Holland & Knight LLP

(57) ABSTRACT

An assembly and method for installing a back-band utilize ratchet straps and pawl members interconnected with the back band and cockpit area of a kayak. The pawl member may be mounted to either the back-band or kayak. The ratchet strap has a first end insertable in the pawl members, and inclined teeth engage the pawl member. A second end of the ratchet strap is secured to either the kayak or back-band. In addition, a band and buckle assembly may interconnect with the back-band and kayak to support and align the back-band in the kayak cockpit.

25 Claims, 6 Drawing Sheets

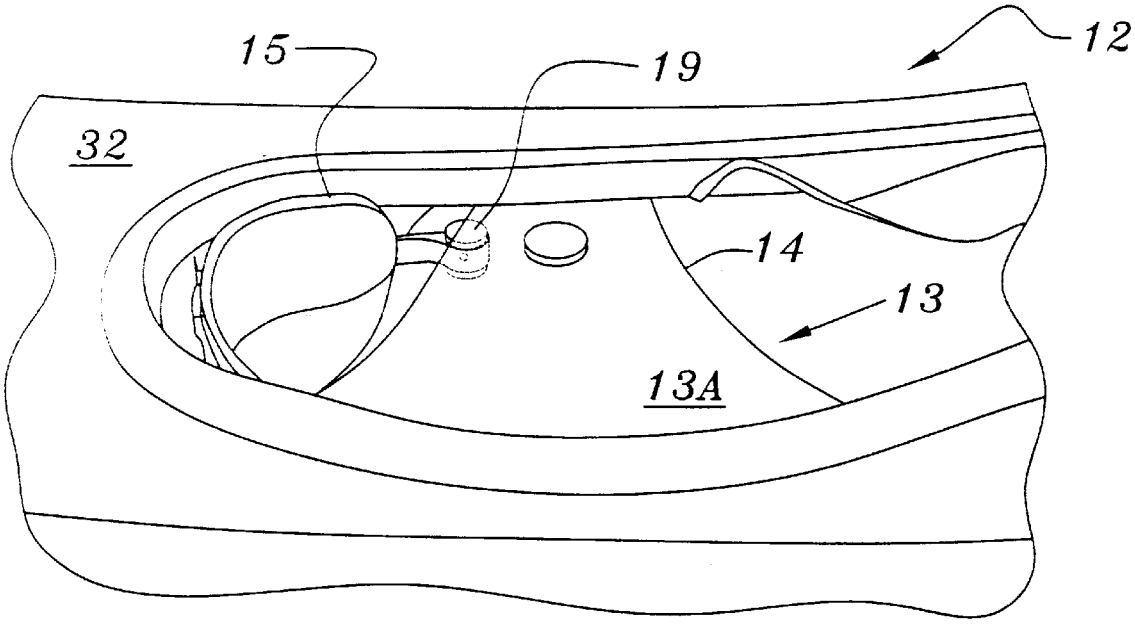
PRIOR ART FIG. 3
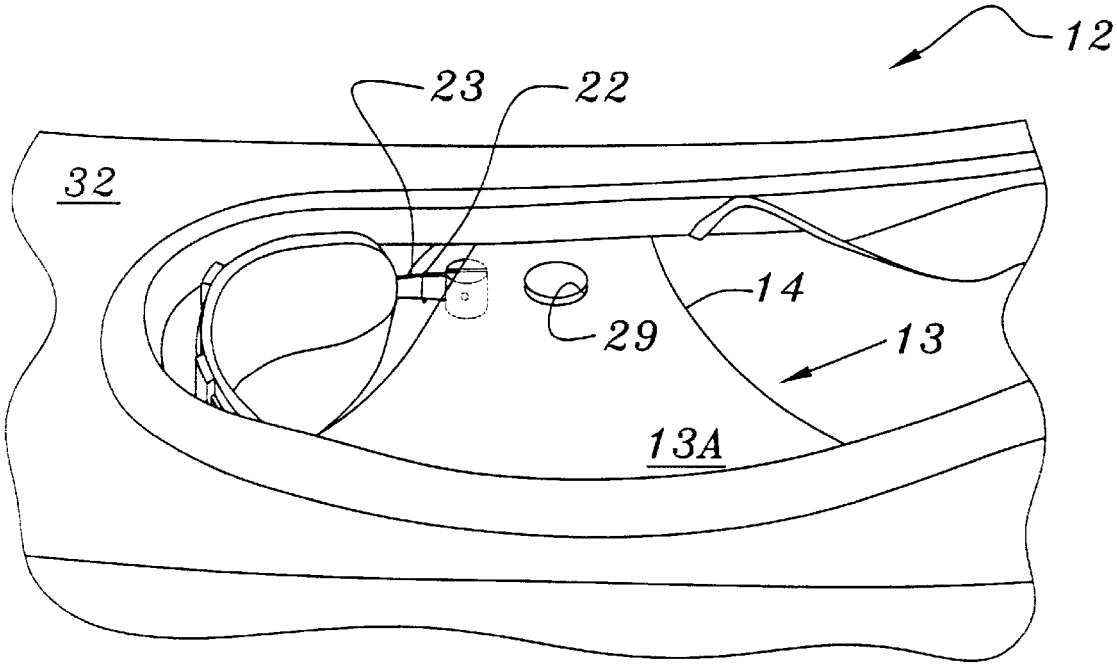
FIG. 6

KAYAK BACK-BAND INSTALLATION ASSEMBLY AND METHOD FOR INSTALLING A BACK-BAND IN A KAYAK

FIELD OF THE INVENTION

This invention relates generally to kayaks, and specifically to back-bands used with kayaks. More specifically, the invention pertains to those assemblies and methods used to install a back-band in a cockpit of a kayak.

BACKGROUND OF THE INVENTION

Kayaking continues to increase in popularity as a recreational outdoor sport and activity. A kayak is a single hulled water vessel that is propelled in the water by paddles controlled by a user. This invention is for use with a single-manned kayak 11 as shown in FIG. 1. This particular model kayak has a semi-enclosed cockpit 12 within which a kayaker may sit.

A seat 13 is mounted in the cockpit 12 for supporting the kayaker. The seat 13 is attached to the hull by seat towers 14. As shown in FIG. 1, two seat towers 14 are integrally molded to the seat 13 and the inside surface of the cockpit 12. The seat towers 14 depend substantially vertically from the top of the cockpit 12 to the seat 13, suspending the seat within the cockpit 12. Accessory parts are manufactured to adapt the seat 13 and cockpit area for the comfort of the kayaker. One such part is a back-band that is attached to the seat towers, or other areas of the cockpit. The back-band is secured in the cockpit so the back-band is suspended rearward of the seat to support the kayakers' back while sitting in the kayak.

Generally, back-bands include an elongated padded member. Straps are attached to the back-band and to different parts of the kayak within the cockpit area. One such back-band 15 is manufactured by Bomber Gear, Inc., shown in FIG. 2, and includes a foam piece covered by a skin. A nylon strap 16, sewn to the skin, has two looped ends 18. As illustrated in FIG. 3, each end of the strap 16 is inserted through an aperture machined through a flange on respective seats tower 14. As shown in FIG. 2, a section of "pvc" pipe 19 is fitted in each looped end 18 of the strap 16, and secured in the looped end 18 by a flexible wire 20. The pipe section 19 prevents the strap 16 from slipping through the aperture on the seat tower 14. The back strap is tightened or loosened by a buckle 17 through which the strap is threaded.

These prior art back-bands suffer from certain inefficiencies. The straps are made of a nylon-webbed material typically used for such a buckle and strap assemblies. The straps are awkward to handle during installation of the back-band. In addition, the back-bands require assembly of parts as described which unnecessarily complicate installation of existing back-bands.

SUMMARY OF THE INVENTION

In view of the foregoing, an object of the present invention is to provide a back-band is to provide an installation assembly for a back-band for use in a kayak, that is easier to install, costs less to manufacture, and is more efficient in use.

These and other objectives are met by using a ratchet installation assembly. The assembly utilizes ratchet straps and pawl members interconnected with the back band and cockpit area of a kayak. The pawl member may be mounted to either the back-band or kayak. The ratchet strap has a first end insertable in the pawl members, and inclined teeth engage the pawl member. A second end of the ratchet strap is secured to either the kayak or back-band. In addition, a band and buckle assembly may interconnect with the back-band and kayak to support and align the back-band in the kayak cockpit.

BRIEF DESCRIPTION OF THE DRAWINGS

FIG. 3 is the prior art back-band installed in a kayak.

FIG. 6 is a perspective view of the first embodiment of the invention.

DETAILED DESCRIPTION OF THE DRAWINGS

Figure 1:
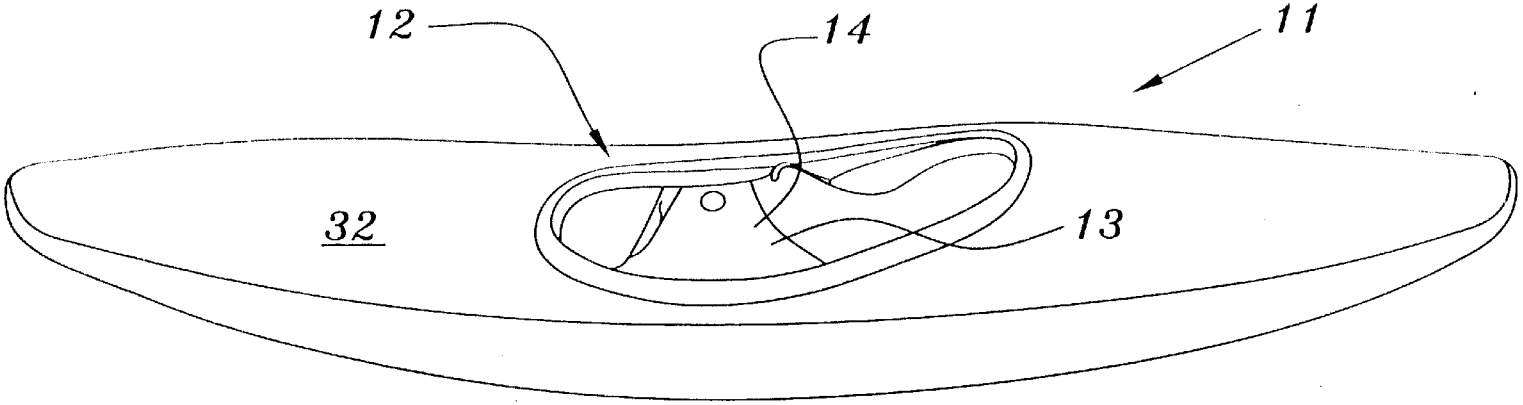
FIG. 1 is a perspective view of a kayak.
Figure 2:
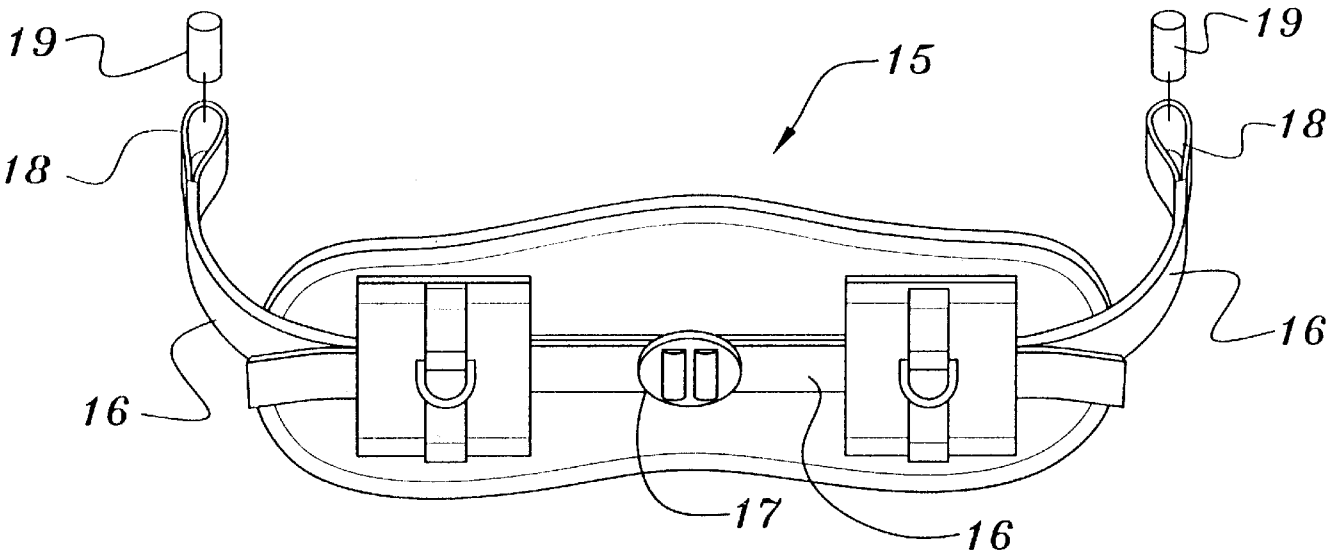
FIG. 2 PRIOR ART
FIG. 2 is a prior art back-band strap assembly.

In FIG. 1, a kayak 11 is illustrated as a single hull water vessel. The kayak 11 has a cockpit 12 which includes a seat 13 for supporting a kayaker. A kayak has a shell forming the hull 32 of the vessel, which is constructed from polyethylene. The seat 13 includes a substantially horizontal member 13A (FIG. 8) and the upright supports 14, also referred to as seat towers 14, which are fixed to the hull 32 adjacent a rim 35 of the cockpit 12. The seat towers 14 have sections 26, which extend laterally from the seat towers 14 to the sides of the kayak 11.

Figure 4:
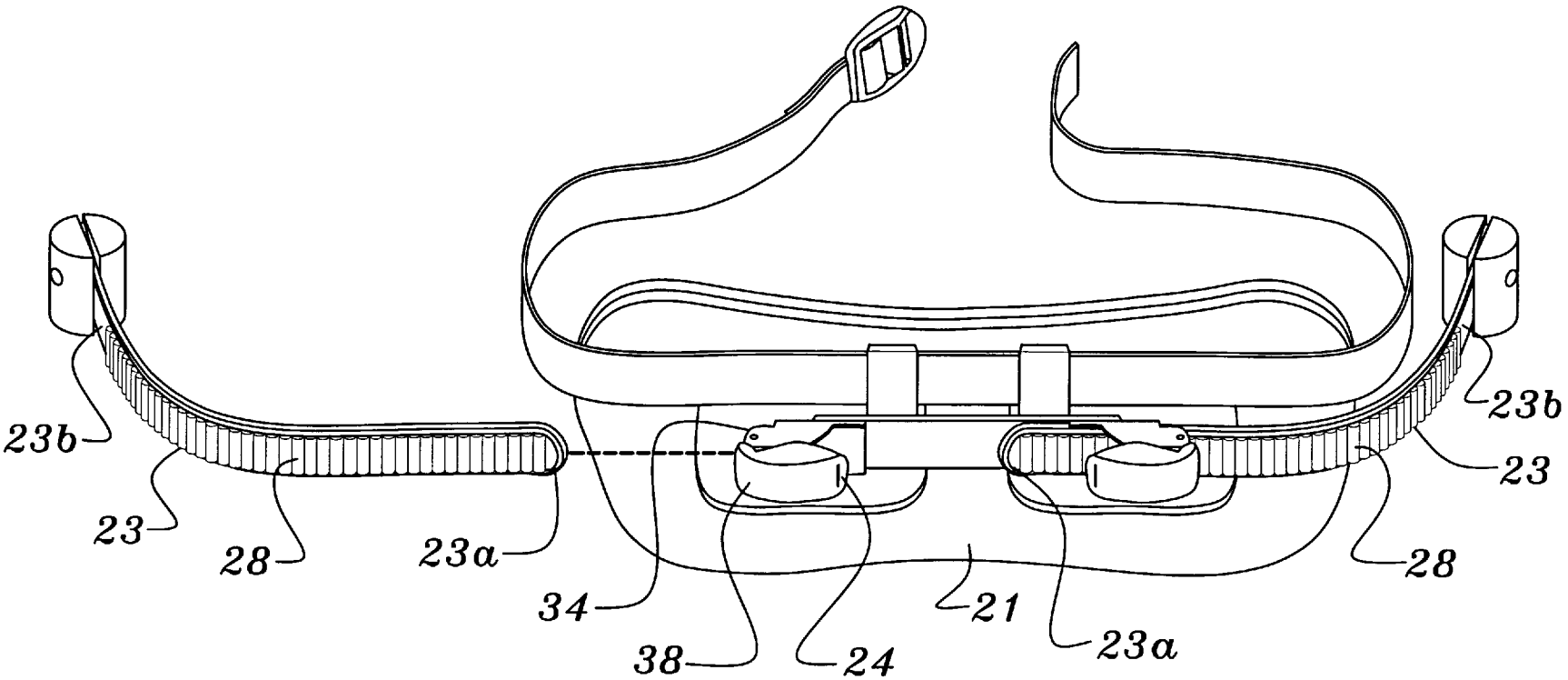
FIG. 4 is a perspective view of a first embodiment of the invention.

With respect to FIG. 4, a first embodiment of the invention is shown including a back-band 21 having a ratchet assembly for securing the back-band 21 within the cockpit 12 of the kayak 11. The ratchet assembly includes two pawl members 24 mounted to a backside 21A of the back-band 21. Two ratchet straps 23 are insertable into the pawl members 24, and connected to an area within the interior of the hull 32 of the kayak 11 and/or within the cockpit 12 of the kayak 11.

Each of the ratchet straps 23 is a resilient elongated member having a first end 23A insertable through the pawl member 24, and a second end 23B upon which a knob 25 is fixed. The ratchet strap is about 10½ inches in length. The ratchet straps 23 have a plurality of inclined teeth 28 disposed along a surface of the ratchet strap 23. The inclined teeth 28 engage the pawl member 24 securing the ratchet strap 23 on the back-band 21.

In a preferred embodiment, the ratchet straps are approximately 10½ inches long, and about 1 inch thick. The thickness of the strap is approximately ⅙ to ⅛ inches thick measured from the crest or peak of an inclined tooth to a back surface of the strap 23. The straps 23 may be obtained from manufacturers of snowboards having the boots and ratchet straps as known to one skilled in the art. For example, straps (as well as the pawl members 24 referred to below) can be purchased from either Everest, S.P.A., or ATA, each located in Italy.

Figure 5:
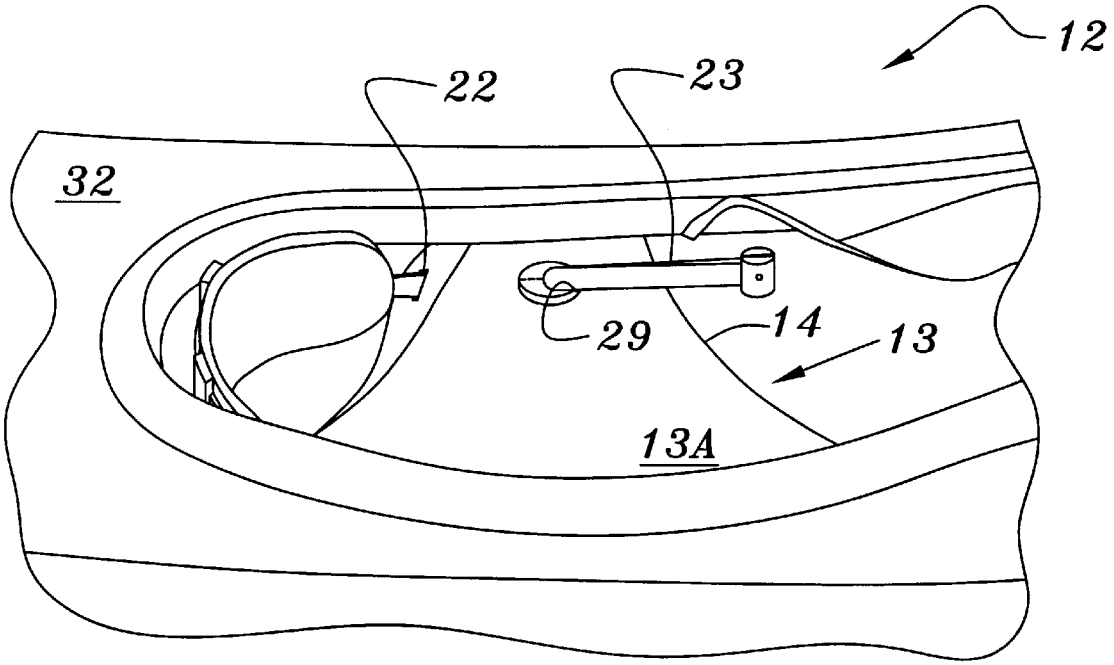
FIG. 5 is a sectional view of a kayak cockpit showing the first embodiment of the invention installed in a kayak.

In FIGS. 5 and 6, the back-band 21 is shown installed in the cockpit 12 of the kayak 11. A slot 22 is drilled into the section 26 disposed toward the stern of the kayak on each seat tower 14. The slot 22 is made large enough so the ratchet strap 23 fits snugly through the slot 22. To that end, the slot 22 is preferably one inch in length and approximately 3/16 of an inch wide. Each seat tower 14 is usually manufactured with a two-inch diameter hole 29 in the seat tower 14 within which a pad (not shown) is secured for the comfort of the kayaker. The pad is removed and the first end 23A of the ratchet strap 23 is inserted through the hole 29 and then through the slot 22. The ratchet strap 23 is then guided through pawl member 24 that engages the inclined teeth 28 of the ratchet strap 23 securing the ratchet strap 23 on the back-band 21.

The pawl member 24 includes engagement member and a biasing member 38 mounted to a bracket 39 that is riveted to the back band 21. As the first end 23A of the ratchet strap 23 is inserted through the pawl member 24 the biasing member 38 automatically opens and closes engaging the strap 23. In this manner, the length of the ratchet strap 23 inserted through the pawl member 24 is adjustable to a desired length, and the back-band 21 may be centered over the seat of the cockpit. When a kayaker seats himself in the kayak 11, the back-band 21 supports the lower back of the kayaker. The knob 25 on the second end 23B of the ratchet strap 23 prevents the ratchet strap 23 from sliding through the slot 22, securing the back-band 22 in the kayak 11. The desired slack or tension between the ratchet strap 23 and back-band 21 is determined by adjusting the ratchet strap 23 length through the pawl member 24 as above described. The knob 25 is a plastic member including two halves riveted to the second end 23B of the ratchet strap; therefore eliminating with need for assembly as in prior art devices.

Figure 8:
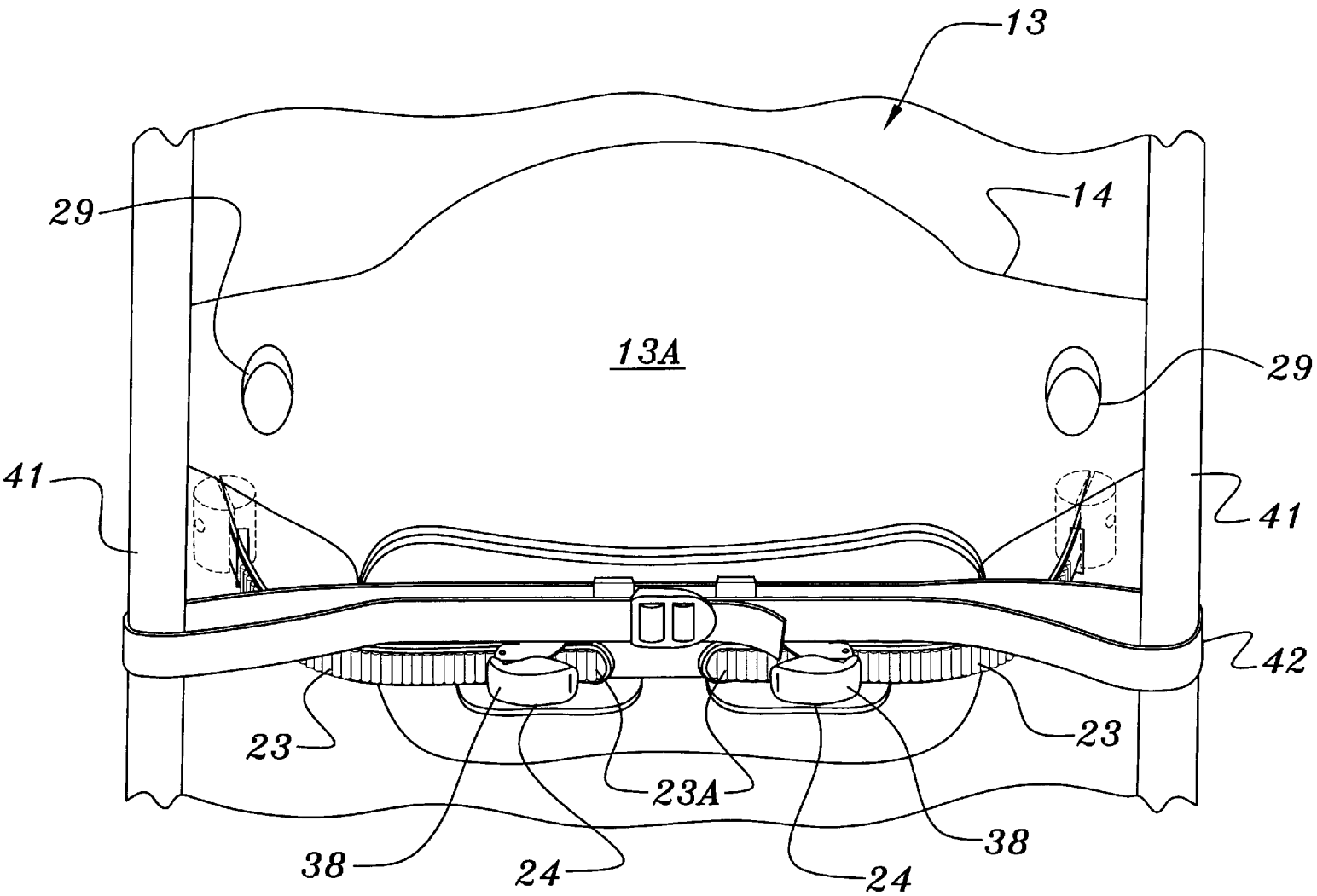
FIG. 8 is a top view of a third embodiment of the invention.

Additional support and adjustment to the back-band 21 may be added by attachment of a strap and buckle mechanism along the cockpit area. As shown in FIG. 8, the nylon strap 42 threads through apertures formed along or around the cockpit rim 39 of the kayak 11, adjacent the seat 13 toward the stern of the vessel. In addition, each end of the strap 42 is laced through a buckle 46. The nylon strapping is interconnected to the back band ring. Tightening the strap 42 in the buckle 46 will adjust the height of the back-band 21, and assists centering the back-band on the seat 13.

Figure 7:
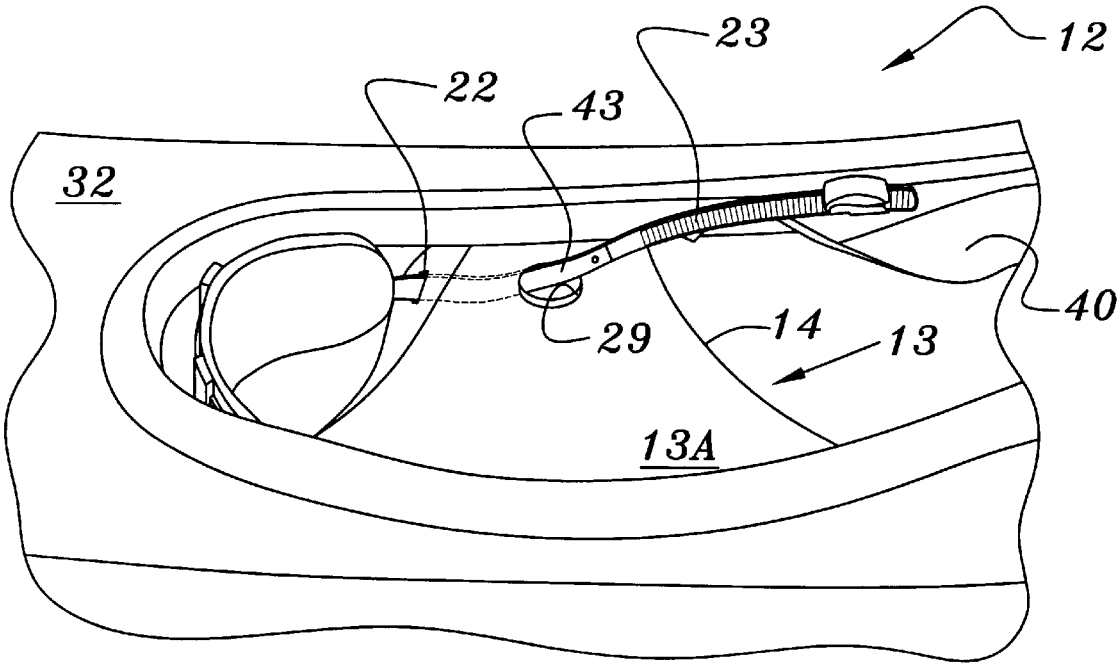
FIG. 7 is a sectional view of the second embodiment of the invention installed in a kayak.

As shown in FIG. 7, the pawl members 24 may be mounted to protrusions within the hull of the kayak or other points. The mounting point shown in FIG. 7 illustrates thigh braces 40 against which a kayaker may brace himself/herself A pawl member 24 is mounted to each thigh brace 40. The first end 23A of the ratchet strap 23 is inserted through the pawl member 24. The second end 23B is fixed to a nylon webbing strap 43 which extends toward the stern to the back-band 21 where it attaches either permanently, or in an adjustable manner as through a buckle. A fixed attachment means includes a grommet and rivet mechanism known to one skilled in the art.

Figure 9:
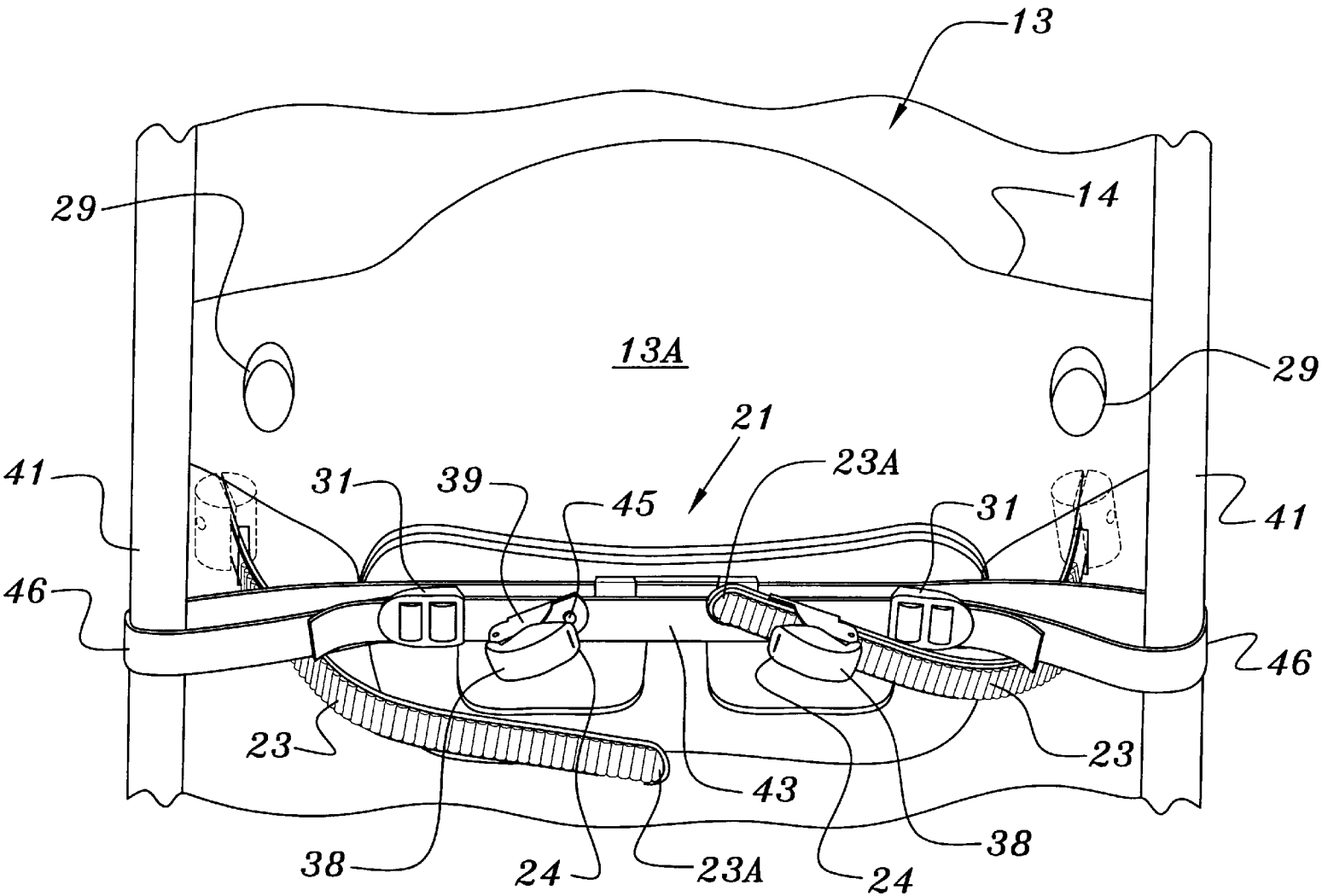
FIG. 9 is rear perspective view of a fourth embodiment of the invention.

In the embodiment shown in FIG. 9, the ratchet assembly 24 and backband are equipped with a nylon strap and buckle mechanism. Two buckles 31 are used in this embodiment. A middle strap 43 is threaded through the fixed end of each buckle 31, and secured to the back band by rivets 45. The pawl member 24 is positioned on the middle strap 43, and the rivet 45 extends through the middle strap 43 and the bracket of a pawl member 24, securing both the pawl member 24 and middle strap 43 to the back-band 21. End straps 46 are threaded through apertures on or around the cockpit rim 39 of the kayak. The end straps 46 are loosened or tightened within the buckle 31 to adjust the back-band 21 to a desired position within the cockpit 12 and/or, secure the back-band 21, as the case may be.

The back-band 21 with the ratchet assembly is not intended to be limited by the means of attachment to the kayak 11, point of attachment of the ratchet straps 23 to the kayak 11, the number of ratchet straps 23 used in its operation. Nor is the invention intended to be limited to the above-described embodiments. That is, the ratchet straps 23 may be secured at points other than the seat towers 14. For example, some cockpits 12 may not be equipped for attachment of the back-band 22, or users may desire operating the ratchet assembly at locations other than the back-band 21.

The ratchet assembly may include only a single ratchet strap 23 and pawl member 24 and the nylon strap and buckle assemble to secure the back-band 21 within the cockpit 11. A single pawl member 24 may be mounted to the center of the back-band 21, or on the thigh brace 40, as described above, and the ratchet strap 23 is threaded through cockpit area for engagement with the pawl member 24.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

I claim as my invention the following:

1. A kayak back-band installation assembly, comprising:

(a) a back-band having an elongated padded or cushioned member for supporting the back of a person operating the kayak;

(b) at least one pawl member mounted to the back-band; and, (c) at least one ratchet strap having a first end extending through said pawl member, and a second end adapted to being secured within a cockpit area of the kayak.

2. A kayak back-band installation assembly as defined in claim 1 further comprising two pawl members mounted on a back surface of the back-band, and two ratchet straps, each ratchet strap having a first end extending through a corresponding pawl member, and a second end adapted to being secured within the cockpit area.

3. A kayak back-band installation assembly as defined in claim 2 wherein said kayak includes a seat mounted in the cockpit of the kayak, and said seat including a substantially horizontal member, two upright support members mounted to a hull of the kayak depending therefrom and suspending said seat within the cockpit, and each said upright support member having a slot through which said ratchet strap is adapted to extend and said ratchet strap having a knob mounted on a second end of each ratchet strap.

4. A kayak back-band installation assembly as defined in claim 1 further comprising a buckle and strap assembly interconnected to the back-band and said band and buckle assembly secured to the back-band and adapted to being secured in the cockpit area of the kayak.

5. A kayak back-band installation assembly as defined in claim 3 wherein said strap and buckle assembly includes a flexible nylon webbing material adapted to being threaded through apertures formed in the cockpit of the kayak and a buckle, adapted to support said back band in the kayak.

6. A kayak back-band installation assembly as defined in claim 3 wherein said strap and buckle assembly include a flexible nylon strapping having a middle strap fixed to the back band and threaded through two buckles, and two end straps with each end strap adapted to being threaded through a slot formed on the kayak and threaded through each said buckle, and said buckle adjustable along a length of respective end straps.

7. A kayak back-band installation assembly, comprising:

(a) a back-band having an elongated padded or cushioned member for supporting the back of a person operating the kayak;

(b) at least one pawl member adapted to be mounted within a cockpit area of the kayak at least one ratchet strap having a first end extending through said pawl member; and, (c) means, attached to a second end of the ratchet strap, to interconnect the second end of the ratchet strap to the back-band.

8. A kayak back-band installation assembly as defined in claim 6 wherein said kayak has a thigh brace in the cockpit area of the kayak, and said pawl member is adapted to be mounted to the thigh brace.

9. A kayak back-band installation assembly as defined in claim 7 wherein said ratchet strap includes a resilient elongated member and a nylon webbing strap secured to a second end of the resilient member and secured to the back-band.

10. A method for installing a back-band in a kayak, comprising:

(a) mounting at least one pawl member on the back-band;

(b) supporting a second end of at least one ratchet strap in the kayak; and, (c) inserting a first end of said ratchet strap through a pawl member.

11. A method as defined in claim 10 wherein the step of supporting the second end of the ratchet strap includes fixing a knob on a second end of the ratchet strap through a slot formed in a seat in the kayak.

12. A method as defined in claim 10 wherein said step of mounting the pawl member on the back-band includes mounting two panel members on a backside of the back-band.

13. A method as defined in claim 12 wherein said step of supporting the second end of the ratchet strap includes supporting the second end of the of the ratchet strap along a seat of the kayak and said step of inserting the first end of the ratchet strap includes inserting the first end of each of the two ratchet straps through a respective pawl member on the back-band.

14. A method as defined in claim 13 wherein the step of supporting the second end of the ratchet strap includes fixing a knob on the second end of each of the two ratchet straps, forming two slots in the seat of the kayak and inserting the first end of each of the ratchet straps through a corresponding slot formed in a seat in the kayak.

15. A method as defined in claim 10 further comprising the step of interconnecting a strap and buckle assembly with attached to the back-band and a cockpit of the kayak.

16. A method as defined in claim 15 wherein said step of interconnecting a strap and buckle assembly includes forming apertures in the cockpit of the kayak, threading a nylon webbing strap through the apertures and at least one buckle, and adjusting the tension of the nylon webbing strap with the buckle.

17. A method as defined in claim 15 wherein said step of interconnecting the strap and buckle assembly includes providing the strap with a middle strap two end straps and two buckles, the middle strap being fixed to a backside of the back-band, each said buckle having an end of the middle strap fixed thereto, and forming apertures in the cockpit of the kayak, threading each end strap through a corresponding aperture and buckle, and adjusting one or both of the end straps in the respective buckles.

18. A method for installing a back-band in a kayak, comprising:

a) mounting at least one pawl member to the kayak;

b) supporting a second end of at least one ratchet strap to the back-band; and, c) inserting a first end of said ratchet strap through the pawl member.

19. A method as defined in claim 18 wherein said step of mounting at least one pawl member includes mounting said at least one pawl member to a thigh brace in the kayak.

20. A method as defined in claim 19 further wherein the step of supporting a second end of the at least two pawl member includes fixing a nylon webbing strap to the second end of the ratchet and fixing the nylon webbing strap to the back-band distal the ratchet strap.

21. A method as defined in claim 18 wherein the step of mounting the at least pawl member includes mounting two pawl members, and providing two opposing thigh braces, each pawl member being mounted to one of the opposing thigh braces.

22. A method as defined in claim 19 wherein the step of supporting a second end of the at least two pawl member includes providing two nylon webbing straps, and fixing each nylon webbing strap to a second end of a respective ratchet and fixing each nylon webbing strap to the back-band distal the ratchet strap.

23. A method as defined in claim 7 further including the step of interconnecting a strap and buckle assembly, attached to the back-band, with a cockpit of the kayak.

24. A method as defined in claim 15 wherein said step of interconnecting a strap and buckle assembly includes forming apertures in the cockpit of the kayak, threading a nylon webbing strap through the apertures and at least one buckle, and adjusting the tension of the nylon webbing strap with the buckle.

25. A method as defined in claim 15 wherein said step of interconnecting the strap and buckle assembly includes providing the strap with a middle strap two end straps and two buckles, the middle strap being fixed to a backside of the back-band, each said buckle having an end of the middle strap fixed thereto, and forming apertures in the cockpit of the kayak, threading each end strap through a corresponding aperture and buckle, and adjusting one or both of the end straps in the respective buckles.

* * * * *